US005628699A

United States Patent [19]

Maruko et al.

[11] Patent Number: 5,628,699

[45] Date of Patent: May 13, 1997

[54] WOUND GOLF BALL

[75] Inventors: Takashi Maruko; Shinichi Kakiuchi; Junji Hayashi, all of Chichibu, Japan

[73] Assignee: Bridgestone Sports Co., Ltd., Tokyo, Japan

[21] Appl. No.: 508,690

[22] Filed: Jul. 28, 1995

[30] Foreign Application Priority Data

Aug. 3, 1994 [JP] Japan ..... 6-201389
Dec. 20, 1994 [JP] Japan ..... 6-334564

[51] Int. Cl.[6] ..... A63B 37/12

[52] U.S. Cl. ..... 473/363; 473/365; 473/351

[58] Field of Search ..... 273/225; 473/357, 473/358, 359, 360, 361, 362, 363, 364, 365, 378

[56] References Cited

U.S. PATENT DOCUMENTS 701,736 6/1902 Kempshall ..... 473/365
4,272,079 6/1981 Nakade et al. ..... 273/225
4,337,946 7/1982 Saito et al. ..... 273/225

FOREIGN PATENT DOCUMENTS 2064338 6/1981 United Kingdom .
2280379 2/1995 United Kingdom .
WO80/01541 8/1980 WIPO .

*Primary Examiner*—George J. Marlo
*Attorney, Agent, or Firm*—Sughrue, Mion, Zinn, Macpeak & Seas

[57] ABSTRACT

In a wound golf ball comprising a solid center (1), thread rubber (2), and a cover (3), the cover has a multi-layer structure including an outer layer (4) and an inner layer (5) having a higher hardness than the outer layer. The outer layer (4) is 0.4–3.0 mm thick, and it is formed of a first ionomer resin having a Shore D hardness of 40 to 55. The inner layer is formed of a second ionomer resin having a Shore D hardness of 55 to 68. The difference in hardness between the first and second ionomer resins is at least 5 in Shore D hardness. The ball affords improved spin and durability.

3 Claims, 1 Drawing Sheet

WOUND GOLF BALL

BACKGROUND OF THE INVENTION

1. Field of the Invention

This invention relates to a thread wound golf ball having improved spin property and durability.

2. Prior Art

Prior art thread wound golf balls with a solid center have two types of covers, that is, ionomer resin covers and balata rubber covers. For simplicity, the thread wound golf balls having a cover of ionomer resin are referred to as wound ionomer balls while the thread wound golf balls having a cover of balata rubber are referred to as wound balata balls. They have advantages and disadvantages. The wound ionomer balls are superior in flying distance when struck with the driver, but considerably inferior in spin properties in the approach play on the green, that is, stoppage on the green. The wound balata balls are less durable, for example, in that their cover at the ball surface can be scuffed or fretted by bunker shots and cut when topped with iron clubs.

For the purpose of improving spin property and durability, a wound golf ball using a softer ionomer resin as the cover was also proposed. This ball has problems that it has little difference in the flying distance associated with the driver from the conventional wound golf balls and that it can be cut in the cover when topped with iron clubs as are the wound balata balls.

SUMMARY OF THE INVENTION

An object of the present invention is to provide a wound golf ball which is satisfactory in flying distance and spin property and is fully durable.

The present invention relates to a thread wound golf ball having a solid center, thread rubber, and a cover. The cover has a multi-layer structure including an outer layer and an inner layer. The inner layer has a higher hardness than the outer layer. The outer layer has a radial thickness of 0.4 mm or more. The resulting wound golf ball affords a flying distance at least comparable to that of the conventional wound ionomer balls having a cover of high hardness ionomer resin. Its spin property is comparable to that of the conventional wound balata balls. Its cover is not readily cut when topped with iron clubs.

Although two-piece solid golf balls having a cover of two-layer structure are known in the art as disclosed in Japanese Patent Application Kokai (JP-A) Nos. 80469/1985 and 290969/1986 and EP 577,058, a two-layer cover has never been proposed for wound golf balls. The thread wound golf ball having a solid center and a cover of the above-defined layer structure according to the present invention affords the following advantages. Since the cover outer layer has a lower hardness or adequate softness, the ball gains a high spin rate and offers good spin properties and controllability on approach shots. Since the cover inner layer has a higher hardness, the cover as a whole offers good repulsion or restitution, an increased initial velocity with a low spin rate, and an increased flying distance on driver shots. A combination of the outer layer having a lower hardness with the inner layer having a higher hardness improves cut resistance and hence, durability. The outer layer formed of an ionomer resin having a lower hardness has higher scuffing resistance and hence, more durable than the balata covers and high hardness ionomer resin covers.

According to the present invention, there is provided a wound golf ball comprising a solid center, a thread rubber layer, and a cover wherein the cover has a multi-layer structure including an outer layer having a thickness of at least 0.4 mm and an inner layer having a hardness higher than that of the outer layer.

BRIEF DESCRIPTION OF THE DRAWINGS

The only FIGURE.

BEST MODE FOR CARRYING OUT THE INVENTION

Figure 1:
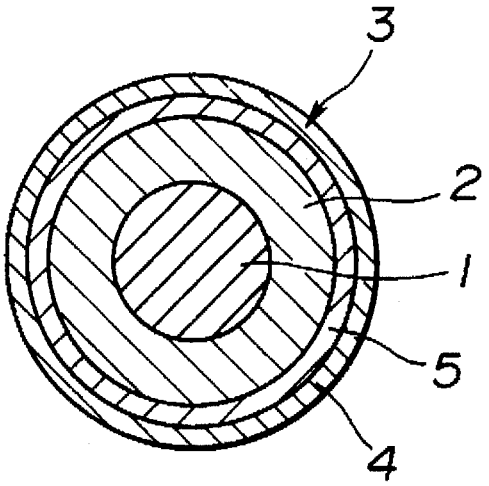
FIG. 1 is a schematic cross-sectional view of one exemplary wound golf ball.

Referring to FIG. 1, a wound golf ball is illustrated as comprising a spherical solid center 1. Thread rubber is wound on the center 1 to form a thread rubber layer 2, which is enclosed in a cover 3. According to the invention, the cover 3 has a multi-layer structure, typically a two layer structure consisting of a radially outer layer 4 and a radially inner layer 5.

Each of the outer and inner layers 4 and 5 is generally formed of a composition comprising a well-known cover resin such as ionomer resins and balata rubber and conventional amounts of optional additives including pigments such as titanium white and dispersants such as magnesium stearate. The outer layer has a first hardness which is relatively low and the inner layer has a second hardness which is higher than the first hardness.

The outer layer is preferably formed of a resin having a Shore D hardness of 40 to 55, more preferably 45 to 51. Useful resins are ionomer resins, for example, Himilan 8120, 8220 and 8320 commercially available from Mitsui-dupont Polychemical K.K. and mixtures of two or more of them as well as balata rubber.

The inner layer is preferably formed of a resin having a Shore D hardness of 55 to 68, more preferably 60 to 66. Useful resins are ionomer resins, for example, Himilan 1554, 1555, 1601, 1702, 1705, and 1706 commercially available from Mitsui-duPont Polychemical K.K. and mixtures of two or more of them.

The difference in hardness between the inner and outer layer resins should preferably be at least 5, especially at least 10 in Shore D hardness.

According to the present invention, the outer layer should have a radial thickness of at least 0.4 mm, especially 0.4 to 3.0 mm. An outer layer of less than 0.4 mm fails to provide spin properties on approach shots. A ball with an outer layer of more than 3.0 mm would be less repulsive and afford a shorter flying distance.

It is recommended that the outer and inner layers have a total thickness of 1.0 to 4.0 mm, especially 1.5 to 2.5 mm. The ratio of the outer layer thickness to the inner layer thickness is desirably from 3:7 to 7:3. If the total thickness is less than 1.0 mm, the cover would be less durable against topping. If the total thickness is beyond 4.0 mm, the ball would be sometimes low in initial velocity. If the outer layer is thinner outside the above-defined ratio range, a problem would arise with respect to spin on approach shots. If the outer layer is thicker outside the above-defined ratio range, the flying distance associated with the driver would be short.

The wound golf ball of the invention has a solid center rather than a liquid center. This prevents shortening of the flying distance during play at low temperature as compared with the wound golf balls with a liquid center. The solid center preferably has an outer diameter of 27 to 38 mm, especially 29 to 35 mm. If the solid center is less than 27 mm in diameter, a ball would receive more spin, follow a rather getting-up trajectory, and fly a shorter distance against a head wind. A solid center having a diameter of more than 38 mm is too large to wound thread rubber thereon to a proper thickness so that the ball might fail to provide adequate hardness for hitting feel unless the solid center is extremely hard.

The solid center can be formed by any well-known technique. For example, a well-known rubber composition comprising base rubber and a peroxide is molded under heat and pressure to form the solid center. The base rubber may be polybutadiene rubber or a mixture of polybutadiene rubber and polyisoprene rubber which are conventionally used in solid golf balls. In the practice of the invention, 1,4-polybutadiene rubber having more than 90% of cis-structure is preferred for higher repulsion. Co-crosslinking agents which are conventionally used in solid golf balls include zinc and magnesium salts of unsaturated fatty acids such as methacrylic acid and acrylic acid and esters such as trimethylpropane trimethacrylate. These agents may be used in the rubber composition for the solid center. Zinc acrylate is most preferred because of high repulsion. Typically about 15 to 30 parts by weight of the co-crosslinking agent is blended with 100 parts by weight of the base rubber. Any well-known peroxide may be used. Preferred are dicumyl peroxide and mixtures of dicumyl peroxide and 1,1-bis(t-butylperoxy)-3,3,5-trimethylcyclohexane. Typically about 0.5 to 1.5 parts by weight of the peroxide is blended with 100 parts by weight of the base rubber. The rubber composition may optionally contain zinc oxide and barium sulfate for specific gravity adjustment and an anti-oxidant.

The hardness of the solid center is not critical since it is determined by considering the feel to the player on impacts entailing great deflection as by driver hits and the head speed of the player. Most often, the solid center has a hardness of 45 to 80, especially 60 to 80 on JIS C hardness scale as measured at the solid core surface.

The type of thread rubber wound on the solid center and the winding technique may be conventional.

After a core is formed by winding a thread rubber layer on the solid center, any desired technique may be used in enclosing the core in a cover of multi-layer structure. For example, each covering composition is directly injection molded around the core. Alternatively, a pair of hemispherical cups are formed from each covering composition and the core is surrounded by the dual cups, which is press molded at 110° to 160° C. for about 2 to 10 minutes.

The wound golf ball of the invention has a diameter and weight meeting the Golf Association Standards, that is, a diameter of at least 42.67 mm and a weight of up to 45.92 g.

EXAMPLE

Examples of the present invention are given below by way of illustration and not by way of limitation.

Examples 1–7 and Comparative Examples 1–4

Each solid center was prepared by blending suitable ingredients to form a rubber composition as shown in Table 1, milling the composition in a roll mill, and press molding the composition at 155° C. for 15 minutes to form a center ball.

TABLE 1

| | Solid center | | |
|---|---|---|---|
| Composition (pbw) | 1 | 2 | 3 |
| Polybutadiene rubber | 100 | 100 | 100 |
| Stearic acid | 1 | 1 | 1 |
| Zinc oxide | 30 | 45 | 20 |
| Lead acrylate | 22 | 6 | 25 |
| Barium sulfate | 35 | 60 | 21 |
| Dicumyl peroxide | 1.2 | 1.2 | 1.2 |
| Center outer diameter | 31.8 mm | 27.8 mm | 35.3 mm |

Thread rubber was wound on the solid center by a conventional winding technique to form a thread rubber layer of about 6 mm thick.

Each cover composition was prepared by blending 100 parts by weight of a resin as shown in Table 2 with 5 parts by weight of titanium oxide and 0.3 parts by weight of magnesium stearate in a twin screw extruder. The cover composition was molded into hemispherical cups.

TABLE 2

| | Cover composition | | | |
|---|---|---|---|---|
| Ionomer resin (pbw) | R1 | R2 | R3 | R4 |
| H1557 (Zn) | 25 | — | — | — |
| S8120 (Na) | 50 | — | — | — |
| S8320 | — | 65 | 90 | — |
| H1605 (Zn) | — | — | — | 50 |
| H1650 | — | 35 | 10 | — |
| H1706 (Zn) | — | — | — | 50 |
| H1856 (Na) | 25 | — | — | — |
| Cover resin hardness (Shore D) | 51 | 47 | 41 | 64 |

A wound golf ball was prepared by combining a pair of cups of one type with a pair of cups of another type in concentric overlap, mating a pair of dual cups so as to enclose the core therein, and compression molding the cups to form a cover.

Each of the thus prepared golf balls was tested for carry, total distance (carry+run), spin, and elevation angle by hitting with the driver and sand wedge. The results are shown in Table 3. The ball was also examined for cut durability by hitting with the sand wedge at a head speed (HS) of 36 m/s.

TABLE 3

| | Example | | | | | | | Comparative Example | | | |
|---|---|---|---|---|---|---|---|---|---|---|---|
| | 1 | 2 | 3 | 4 | 5 | 6 | 7 | 1 | 2 | 3 | 4 |
| Solid center | | | | | | | | | | | |
| Outer diameter (mm) | 31.8 | 31.8 | 31.8 | 31.8 | 31.8 | 27.8 | 35.3 | 31.8 | 31.8 | 31.8 | 31.8 |
| Weight (g) | 23.4 | 23.4 | 23.4 | 23.4 | 23.4 | 17.8 | 29.3 | 23.4 | 23.4 | 23.4 | 23.4 |
| Hardness*1 (mm) | 1.91 | 1.91 | 1.91 | 1.91 | 1.91 | 4.21 | 3.87 | 1.91 | 1.91 | 1.91 | 1.91 |

TABLE 3-continued

| | Example | | | | | | | Comparative Example | | | |
|---|---|---|---|---|---|---|---|---|---|---|---|
| | 1 | 2 | 3 | 4 | 5 | 6 | 7 | 1 | 2 | 3 | 4 |
| Cover | | | | | | | | | | | |
| Structure | 2 layer | 2 layer | 2 layer | 2 layer | 2 layer | 2 layer | 2 layer | 1 layer | 1 layer | 2 layer | balate |
| Outer layer (Shore D) | R1 (51) | R2 (47) | R3 (41) | R1 (51) | R1 (51) | R1 (51) | R1 (51) | R1 (51) | R4 (64) | R4 (64) | (48) |
| Inner layer (Shore D) | R4 (64) | R4 (64) | R4 (64) | R4 (64) | R4 (64) | R4 (64) | R4 (64) | R1 (51) | R4 (64) | R1 (51) | (48) |
| Thickness (mm) | 1.8 | 1.8 | 1.8 | 1.8 | 1.8 | 1.8 | 1.8 | 1.8 | 1.8 | 1.8 | 1.8 |
| Thickness ratio*2 | 5:5 | 5:5 | 5:5 | 3:7 | 7:3 | 5:5 | 5:5 | — | — | 5:5 | — |
| Performance | | | | | | | | | | | |
| W#1, HS = 45 m/s | | | | | | | | | | | |
| Carry (m) | 214.0 | 213.2 | 231.0 | 214.1 | 213.1 | 213.2 | 213.9 | 212.1 | 214.3 | 213.3 | 211.9 |
| Total distance (m) | 231.8 | 231.5 | 231.1 | 232.0 | 231.6 | 231.2 | 232.2 | 229.4 | 232.3 | 232.1 | 229.1 |
| Spin (rpm) | 2770 | 2790 | 2890 | 2760 | 2800 | 2890 | 2680 | 2960 | 2720 | 2730 | 3000 |
| Elevation angle (°) | 11.6 | 11.6 | 11.7 | 11.6 | 11.6 | 11.7 | 11.5 | 11.8 | 11.6 | 11.6 | 11.9 |
| W#1, HS = 50 m/s | | | | | | | | | | | |
| Carry (m) | 243.5 | 243.4 | 243.5 | 243.7 | 243.2 | 243.5 | 243.3 | 243.4 | 244.2 | 244.1 | 242.9 |
| Total distance (m) | 261.5 | 261.1 | 259.2 | 261.7 | 260.9 | 261.0 | 261.8 | 258.3 | 261.6 | 261.4 | 258.0 |
| Spin (rpm) | 2670 | 2680 | 2760 | 2660 | 2690 | 2790 | 2580 | 2880 | 2610 | 2630 | 2950 |
| Elevation angle (°) | 11.5 | 11.5 | 11.6 | 11.5 | 11.5 | 11.6 | 11.5 | 11.7 | 11.5 | 11.5 | 11.8 |
| SW, HS = 20 m/s | 6030 | 6120 | 6340 | 5990 | 6120 | 6050 | 6010 | 6130 | 4570 | 4590 | 6160 |
| Spin (rpm) | | | | | | | | | | | |
| Cut durability*3 | 0/30 | — | — | — | — | — | — | 8/30 | 0/30 | — | — |
| SW, HS = 36 m/s | | | | | | | | | | | |

*1Hardness is a deflection of the solid center under a load of 30 kg.
*2Thickness ratio is outer layer thickness/inner layer thickness.
*3The number of balls with cover failure or ball distortion from sphericity It is evident that the wound golf balls of the present invention are improved in spin property and durability.

Japanese Patent Application No. 201389/1994 and No. 334564/1994 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising a solid center, thread rubber wound thereon, and a cover enclosing the wound center, wherein said cover has a multi-layer structure including an outer layer having a first hardness and a thickness of at least 0.4 mm and an inner layer having a second hardness higher than the first hardness, said outer layer of said cover being formed of a first ionomer resin having a Shore D hardness of 40 to 55, and the inner layer being formed of a second ionomer resin having a Shore D hardness of 55 to 68, the difference in hardness between the first and second ionomer resins being at least 5 in Shore D hardness.

2. The wound golf ball of claim 1 wherein the outer and inner layers have a total thickness of 1.0 to 4.0 mm and the ratio of the outer layer thickness to the inner layer thickness is from 3:7 to 7:3.

3. The wound golf ball of claim 1 wherein said solid center has an outer diameter of 27 to 38 mm.

* * * * *